US011286590B2

(12) United States Patent
Wang

(10) Patent No.: US 11,286,590 B2
(45) Date of Patent: Mar. 29, 2022

(54) METHOD FOR PRODUCING DURABLE FLUFFY AND SOFT LOOP FABRIC HAVING EMBEDDED WEFT FLOATS

(71) Applicant: LOFTEX CHINA LTD., Shandong (CN)

(72) Inventor: Hongxing Wang, Binzhou (CN)

(73) Assignee: LOFTEX CHINA LTD., Binzhou (CN)

( * ) Notice: Subject to any disclaimer, the term of this patent is extended or adjusted under 35 U.S.C. 154(b) by 0 days.

(21) Appl. No.: 17/043,489

(22) PCT Filed: May 22, 2018

(86) PCT No.: PCT/CN2018/087855

§ 371 (c)(1),
(2) Date: Sep. 29, 2020

(87) PCT Pub. No.: WO2019/213992

PCT Pub. Date: Nov. 14, 2019

(65) Prior Publication Data

US 2021/0140077 A1 May 13, 2021

(30) Foreign Application Priority Data

May 11, 2018 (CN) ..... 201810448025.6

(51) Int. Cl.
*D03D 27/04* (2006.01)
*D03D 15/41* (2021.01)
(Continued)

(52) U.S. Cl.
CPC ..... *D03D 27/04* (2013.01); *D03D 13/00* (2013.01); *D03D 15/41* (2021.01);
(Continued)

(58) Field of Classification Search
CPC ..... D03D 27/04; D03D 15/41; D03D 13/00; D03D 13/004; D03D 15/54; D03D 15/217;
(Continued)

(56) References Cited

U.S. PATENT DOCUMENTS 1,999,044 A * 4/1935 Frank ..... D03D 15/00 139/402
5,244,718 A * 9/1993 Taylor ..... A61B 46/00 442/208

(Continued)

FOREIGN PATENT DOCUMENTS

CN 2763305 Y 3/2006
CN 101165246 A 4/2008

(Continued)

OTHER PUBLICATIONS

Feb. 11, 2019 Search Report issued in International Patent Application No. PCT/CN2018/087855.

*Primary Examiner* — Robert H Muromoto, Jr.
(74) *Attorney, Agent, or Firm* — Oliff PLC

(57) ABSTRACT

A method for producing durable fluffy and soft loop fabric having embedded weft floats, including: 1) yarn selection; 2) winding; 3) warping; 4) sizing; 5) weaving; and 6) dyeing and finishing. During the weaving process, low-twist or zero-twist yarns or filament long floats are embedded into loops. During the dyeing and finishing process, due to weft-wise shrinkage, the embedded weft floats shrink and expand, thereby supporting the loops upright without lodging. In addition, the fluffy zero-twist yarns and interlaced yarn floats form a stacked stereoscopic structure with other weft yarns fixedly connected to the loops, thereby facilitating the extension of the loops and enlarging moisture diffusion surfaces of the loops during baking and air-drying processes to create a rapid drying condition for towels. Therefore, a loop fabric which has a special style and a fluffy and soft hand feeling and is still fluffy and soft after being washed is obtained.

6 Claims, 2 Drawing Sheets

(51) Int. Cl.

| | |
|---|---|
| ***D03D 13/00*** | (2006.01) |
| ***D06M 16/00*** | (2006.01) |
| ***D06P 1/38*** | (2006.01) |
| *D03D 15/00* | (2021.01) |
| *D06M 101/32* | (2006.01) |

(52) U.S. Cl.
CPC ..... *D06M 16/003* (2013.01); *D06P 1/38* (2013.01); *D06M 2101/32* (2013.01)

(58) Field of Classification Search
CPC ..... D03D 15/283; D03D 15/00; D03D 27/02; D06M 16/003; D06M 2101/32; D06M 2101/06; D06P 1/38; D06P 3/8228; D10B 2331/04; D10B 2201/02; D06L 4/13
See application file for complete search history.

(56) References Cited

U.S. PATENT DOCUMENTS 6,173,746 B1 * 1/2001 Debaes ..... D03D 13/00 139/392
6,186,189 B1 * 2/2001 Gheysen ..... D03D 27/10 139/392
6,247,506 B1 * 6/2001 Debaes ..... D03D 13/004 139/402
6,289,941 B1 * 9/2001 Debaes ..... D03D 27/10 139/402
6,343,626 B1 * 2/2002 Demey ..... D03D 27/10 139/37
6,367,514 B1 * 4/2002 Demey ..... D03D 27/06 139/403
9,816,209 B2 * 11/2017 Debaes ..... D03D 27/10
2010/0282359 A1 * 11/2010 Rabin ..... D03D 15/00 139/396
2012/0247608 A1 * 10/2012 Govindaswamy ..... D03D 27/08 139/396

FOREIGN PATENT DOCUMENTS

| | | | |
|---|---|---|---|
| CN | 101509168 | A | 8/2009 |
| CN | 201443004 | U | 4/2010 |
| CN | 103015000 | A | 4/2013 |
| CN | 103614847 | A | 3/2014 |
| CN | 104047087 | A | 9/2014 |
| CN | 106835451 | A | 6/2017 |
| EP | 2 534 987 | A1 | 12/2012 |

* cited by examiner

METHOD FOR PRODUCING DURABLE FLUFFY AND SOFT LOOP FABRIC HAVING EMBEDDED WEFT FLOATS

TECHNICAL FIELD

The invention belongs to the field of textile products, which particularly relates to a method for producing durable fluffy and soft loop fabric having embedded weft floats.

BACKGROUND TECHNOLOGY

Towel products are large-quantity and wide-utility daily textiles. On one hand, towels are used and washed in high frequency but always become hard and cost long to get dry in the air or in the dryer. These problems are of great concern to consumers, so they need to be solved urgently.

The best loop fabric for daily use should have the following properties: 1) using natural and environmentally friendly materials, especially in the skin-touch parts; 2) soft, fluffy and comfortable; 3) good water absorption; 4) after washing, the fluff is less and the depilation rate is low; 5) durable soft feel; 6) easy to get dry in the air or in the dryer.

Generally speaking, the first four properties are easy to realize with prior arts, but other technologies are required to realize the properties of durable softness and quick drying: for example blending natural fiber and chemical fibers with quick drying property for loops, or cabling or arranging two kinds of yarns with different compositions, and then dyeing and finishing obtaining such properties.

In the existing invention patents of various kinds of towel, most of them are applying loops special fiber or blending special fiber with natural fiber, or loops with dual component yarns, in order to realize durable soft feel and quick drying performance.

The pile loop fabrics with patent publication number EP 2534987A1 is towels in such structure. The patent describes a durable soft towel in high and low pile structure, which is obtained by arranging adjacently a kind of combined fiber yarns (mainly filament yarns) with fineness lower than 0.6 dtex and natural fiber yarns, and then weaving and dyeing. Although the patent product indeed has the property of easy-wet/easy-dry and durable softness, but there are also a lot of problems in production process, and the product structure is also limited. Take the yarn with fineness lower than 0.6 dtex as an example. This description requires the yarns to be filament yarns, in addition microfiber filament yarns, and the prior art for fiber with fineness lower than 0.6 dtex is mainly synthetic filament with island structure. When this kind of filament yarn weaved with natural fiber yarns together, there will be four problems: 1. the microfiber filament yarns must be interlaced yarns with nodes, or broken filaments will appear during warping, sizing and weaving, which will seriously impact the weaving quality and production efficiency; 2. since modulus of elastic elongation of microfiber yarns and natural fiber yarns are large, both yarns should thread the same harness and the same drop wire during weaving, which is called double-double pile structure in towel industry, or the weaving will be interrupted due to the different tension of the two yarns, and lead to low quality; 3. high energy consumption for dyeing, since the dyeing properties of the natural fiber yarns and the microfiber filament yarns are different, two bath and two step method should be applied, which is high in energy consumption.

Patent No. CN101165246 discloses a hollow cotton towel with a super softness and high water absorption and its producing method, the towel is made of blended hollow loops and six weft piles, which is hard to maintain the softness after washing and does not have the quick drying property.

Obviously, the disclosed patents are with deficiencies, and are substantially differentiated from the technology applied in this invention.

CONTENT OF INVENTION

Aiming to solve above mentioned problems, this invention provides a method for producing durable fluffy and soft loop fabric having embedded weft floats, which can produce a kind of towel with basic towel textile characteristics, controllability, durable softness after washing and quick drying property.

The adopted technical scheme in the invention is that: a method for producing durable fluffy and soft loop fabric having embedded weft floats, mainly comprising: 1) yarn selection, 2) winding, 3) warping, 4) sizing, 5) weaving, and 6) dyeing and finishing, the specific steps are as follows:

1) Yarn selection: there is no special requirement for the composition and yarn count of ground warp yarns and pile warp yarns for pile loop fabrics, the pile warp yarns are further optimized as 5s to 40s untwisted natural fiber yarns or natural fiber blended yarns; the weft yarns are divided into fixed loop weft yarns and embedded floating weft yarns, among which, the ratio of the fixed loop weft yarns and the embedded floating weft yarns is 3:n to 7:n, n being a number greater than or equal to 1, the fixed loop weft yarns are further preferred to be 12s to 21s pure cotton yarn with no special requirements on composition and yarn count; the embedded floating weft yarns are small twisted or untwisted yarns with twist factor less than 260, and further preferably 5s to 16s untwisted yarns in polyester or 200D to 800D draw texturing yarn filament yarns in polyester.

In the process of forming the loops, weave low twisted yarns or untwisted yarns or chemical fiber interlaced yarn floats are woven, after dyeing and finishing, the untwisted yarns or interlaced yarn floats are fluffy and support the roots of the loops, which makes the loops stand upright without lodging, and apart from the soft characteristics of the fluffy zero-twist yarns and interlaced yarn floats, the fluffy zero-twist yarns and interlaced yarn floats further form a stacked stereoscopic structure with other weft yarns fixedly connected to the loops, thereby facilitating the extension of the loops and enlarging moisture diffusion surfaces of the loops during baking and air-drying processes to create a rapid drying condition for towels.

2) Winding: conventional technology of winding is adopted.

3) Warping: applying warping machine for the warping of pile warp and ground warp respectively, and a warping machine such as a BENNINGER batch warping machine is preferred for the warping machine.

4) Sizing: sizing ground warp to satisfy the weaving requirements and enhance the weaving performance of the yarns.

5) Weaving: for single-faced or double-faced pile loop fabric, a loop structure adopts 2/1 modified warp-rib weaves, a ground structure adopts 2/1 warp-rib weaves, two short beating up and one long beating up for each loop; a number of warp yarns crossed by the embedded floating weft yarns of the pile loop fabric is not less than 6, which is further preferred to be 10 to 32; and a number of the embedded floating weft yarns is not less than 1, and it is further preferred to be 2 to 4; interlacing structures of embedded float weft yarns and ground warps should be 13/1 or 16/1 or 24/1 or 32/1 weft-rib weaves. Towel rapier loom such as a G6300 rapier loom is used.

6) Dyeing and finishing: completing below steps in order:

Removal of water soluble silk: the fabric is added when water reaches 90° C. and treated at 100° C. for 50 minutes.

Deoiling of polyester: a dosage of polyester deoiling agent is 3 g/l, treating for 30 min at 100° C., the purpose of deoiling finishing of the loop fabric is to remove the water-repellent ingredients in chemical fiber weft floats or towel component, so as to ensure the hydrophilic property of towels.

Refining and bleaching: the fabric is contacted with a solution containing chelating agent: 0.5 g/l, hydrogen peroxide (mass concentration of 27%): 5 g/l, ionic membrane caustic soda (mass concentration of 32%): 8 g/l, stabilizer of hydrogen peroxide: 0.3 g/l, highly concentrated refining agent in dosage of 1.5 g/l at 98° C. for 60 minutes.

Dyeing: heat up from 30° C. to 60° C., at a speed of 1° C./min, and maintain the temperature of 60° C. for 30 minutes, reactive dyes are adopted (reactive dyes such as REMAZOL® (reactive) navy blue RGB, REMAZOL® golden yellow RGB, REMAZOL® red RGB, etc.).

Thermal washing, soaping: carry out thermal washing for 10 minutes at 85° C., and carry out soaping for 15 minutes at 95° C.

Polishing: a polishing enzyme is used for polishing, a dosage of the polishing enzyme is 0.05% on weight of fabric take polishing treatment for 40 minutes at 55° C.; the polishing enzyme is a neutral polishing enzyme, which is further preferred to be a polishing dye such as NOVOZYMES 8000L.

Soft finishing: a softening agent is used for soft finishing, and the softening agent with antistatic function should be selected in the process of soft finishing to ensure the product appearance and prevent short fiber dropped from fabrics from absorbing to the loops during post treatment; for example: a softening agent such a HUNTSMAN softening agent SFC, with dosage of 3 g/l, carry out soft finishing for 30 minutes at 40° C., can give antistatic function to polyester and other chemical fibers;

Dehydrating, drying, and sewing, and a loose dryer is preferred for drying; and a towel fabric is obtained.

The loose dryer is a tension-free relaxation dryer. The hot wind is forced to blow through the upper and lower crossed nozzle slots, so that the fabric is rubbed by the wind during the drying process and meanwhile, the fabric is transported in step with the conveying mesh and dried in a tension-free status. Therefore, the shrinkage effect is good, and the hand feel of fabrics is full, comfortable and soft.

The process steps and reagent dosage not described in detail in the specific steps of the method for producing durable fluffy and soft loop fabric having embedded weft floats of the invention are conventional technologies in the art, and will not be repeated here.

The invention improves the softness of the fabric through the selection of the yarns and the soft characteristics of the fluffy zero-twist yarns and interlaced yarn floats; in coordination with the dyeing, finishing and weaving processes of the invention, the fluffy zero-twist yarns and interlaced yarn floats further form a stacked stereoscopic structure with other weft yarns fixedly connected to the loops, thereby facilitating the extension of the loops and enlarging moisture diffusion surfaces of the loops during baking and air-drying processes to create a rapid drying condition for towels, endowing softness and rapid drying properties to the fabric and making the properties durable and stable.

BRIEF DESCRIPTION OF THE DRAWINGS

FIG. 1A is a section schematic diagram of the warp direction of the corresponding loop fabrics, FIG. 1B is a weave pattern of ground warp yarns and two weft yarns of the corresponding loop fabrics, and FIG. 1C is a weave pattern of pile warp yarns and two weft yarns of the corresponding loop fabrics;

FIG. 2A is a section schematic diagram of the warp direction of the corresponding loop fabrics, FIG. 2B is a weave pattern of ground warp yarns and two weft yarns of the corresponding loop fabrics, and FIG. 2C is a weave pattern of pile warp yarns and two weft yarns of the corresponding loop fabrics;

FIG. 3A is a section schematic diagram of the warp direction of the corresponding loop fabrics, FIG. 3B is a weave pattern of ground warp yarns and two weft yarns of the corresponding loop fabrics, and FIG. 3C is a weave pattern of pile warp yarns and two weft yarns of the corresponding loop fabrics; FIG. 4A is a section schematic diagram of the warp direction of the corresponding loop fabrics, FIG. 4B is a weave pattern of ground warp yarns and two weft yarns of the corresponding loop fabrics, and FIG. 4C is a weave pattern of pile warp yarns and two weft yarns of the corresponding loop fabrics;

SPECIFIC EMBODIMENTS

The use of these and other examples anywhere in the specification is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. All the technologies realized based on above mentioned contents of this invention are included in the scope of this invention, and unless specially stated, the following embodiments are completed by conventional prior art.

Embodiment 1

Figure 1A:
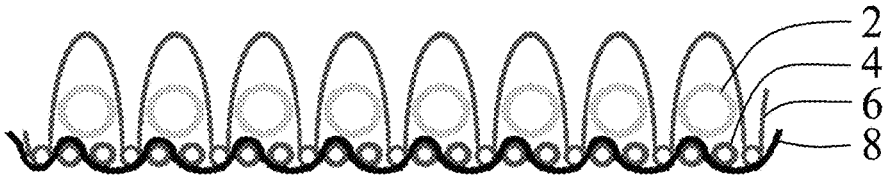
FIGS. 1A-1C are schematic diagrams of a single-faced pile loop fabrics with one weft float embedded in the loops, where
Figure 1B:
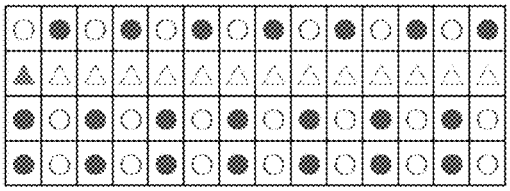
Figure 1C:
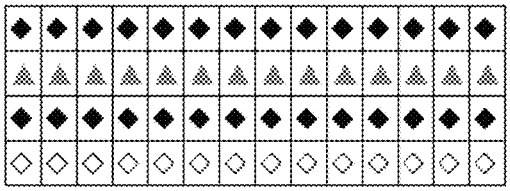
Figure 3A:
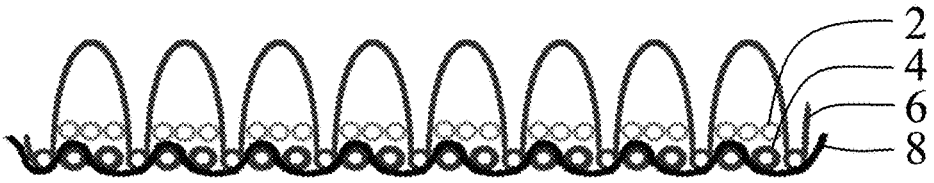
FIGS. 3A-3C are schematic diagrams of a single-faced pile loop fabrics with three weft floats embedded in the loops, where
Figure 3B:
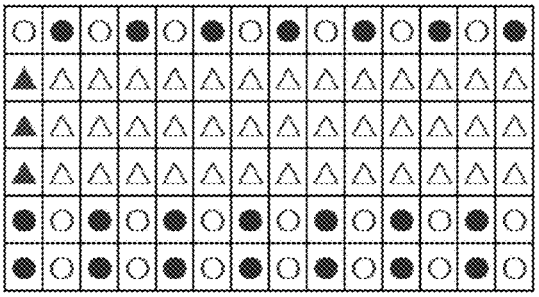
Figure 3C:
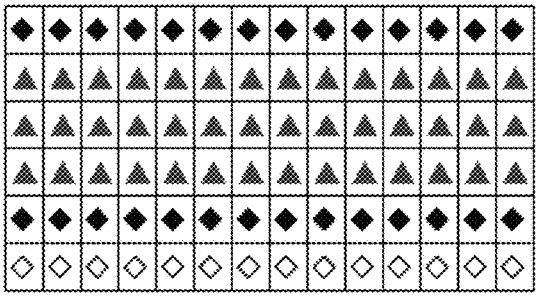

FIGS. 1A-1C and 3A-3C illustrate a durable fluffy and soft single-faced pile loop fabric having embedded weft floats with the single-faced pile loop towel structure of three-weft pile embedded with 1 and 3 floating weft yarns of polyester filament respectively. FIGS. 1A-1C and 3A-3C illustrate embedded floating weft yarns 2, fixed loop weft yarns 4, pile warp yarns 6 and ground warp yarns 8. In FIGS. 1A-1C and 3A-3C, the empty diamond indicates that when the pile warp yarns 6 are interwoven with the fixed loop weft yarns 4, the pile warp yarns 6 are under the weft yarns 4; the filled diamond indicates that when the pile warp yarns 6 are interwoven with the fixed loop weft yarns 4, the pile warp yarns 6 are above the weft yarns 4; the empty circle indicates that when the ground warp yarns 8 are interwoven with the fixed loop weft yarns 4, the ground warp yarns 8 are under the weft yarns 4; the filled circle indicates that when the ground warp yarns 8 are interwoven with the fixed loop weft yarns 4, the warp yarns 8 are above the weft yarns 4; the empty triangle indicates that when the warp yarns 8 are interwoven with the embedded floating weft yarns 2, the warp yarns 8 are under the weft yarns 2; and the filled triangle indicates that when the warp yarns 8 are interwoven with the embedded floating weft yarns 2, the warp yarns 8 are above the weft yarns 2.

The production method of embedded weft floats loop fabrics with weaving process is as follows: winding, warping, weaving, dyeing and sewing.

1. Yarn selection: prepare the yarns with prior arts: pile warp yarns are 12s cotton untwisted yarns, the ground warp yarns are 21s/2 polyester dyed yarns, fixed loop weft yarns are 16s cotton yarns, and embedded floating weft yarns are polyester 600D/576F draw texturing yarn filament yarns.

2. Winding: the existing well-known technology is used for winding on a winder such as the SAVIO winder which is made in Japan.

3. Warping: the existing well-known technology is used to prepare a pile warp beam and a ground warp beam on a warping machine such as a BENNINGER batch warping machine.

4. Sizing: sizing the ground warp beam on a sizing machine such as the KAL-MAYER sizing machine using the existing well-known technology.

5. Weaving: for the single-faced pile loop fabric, a loop structure of fixed loop structure adopts 2/1 modified warp-rib weaves, a ground structure adopts 2/1 warp-rib weaves, two short beating up and one long beating up for each loop; interlacing structures of embedded float weft yarns and ground warps are 13/1 weft-rib weaves. Towel rapier loom such as G6300 rapier loom is used.

6. Dyeing and finishing: the specific steps are as follows:

Removal of water soluble silk: the fabric is added when water reaches 90° C. and treated at 100° C. for 50 minutes.

Deoiling of polyester: a dosage of polyester deoiling agent such as TF-129T of TRANSFAR® is 3 g/l, treating for 30 min at 100° C.

Refining and bleaching: the fabric is contacted with a solution containing chelating agent: 0.5 g/l, hydrogen peroxide (mass concentration of 27%): 5 g/l, ionic membrane caustic soda (mass concentration of 32%): 8 g/l, stabilizer of hydrogen peroxide: 0.3 g/l, highly concentrated refining agent in dosage of 1.5 g/l at 98° C. for 60 minutes.

Dyeing: heat up from 30° C. to 60° C., at a speed of 1° C./min, and maintain the temperature of 60° C. for 30 minutes, reactive dyes are adopted (reactive dye such as REMAZOL® navy blue RGB etc.).

Thermal washing, soaping: carry out thermal washing for 10 minutes at 85° C., and carry out soaping for 15 minutes at 95° C.

Polishing: a neutral polishing enzyme of NOVOZYMES 8000L is used for polishing, a dosage of the polishing enzyme is 0.05% on weight of fabric, take polishing treatment for 40 minutes at 55° C.

Soft finishing: a softening agent such as HUNTSMAN softening agent SFC, with dosage of 3 g/l, carry out soft finishing for 30 minutes at 40° C.

Dehydrating, drying, a loose dryer is used for drying, sewing, and a single-faced towel fabric is obtained.

Embodiment 2

Figure 2A:
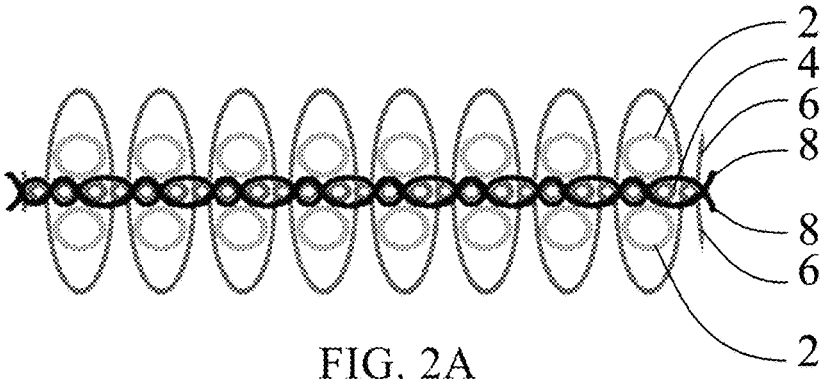
FIGS. 2A-2C are schematic diagrams of a double-faced pile loop fabrics with one weft float embedded in the loops, where
Figure 2B:
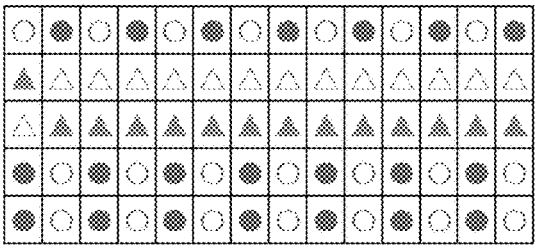
Figure 2C:
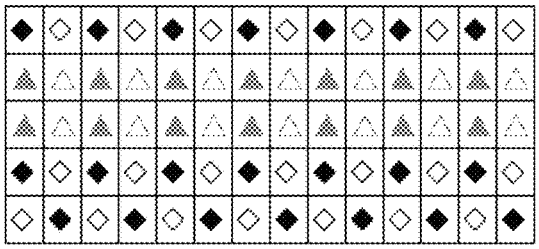
Figure 4A:
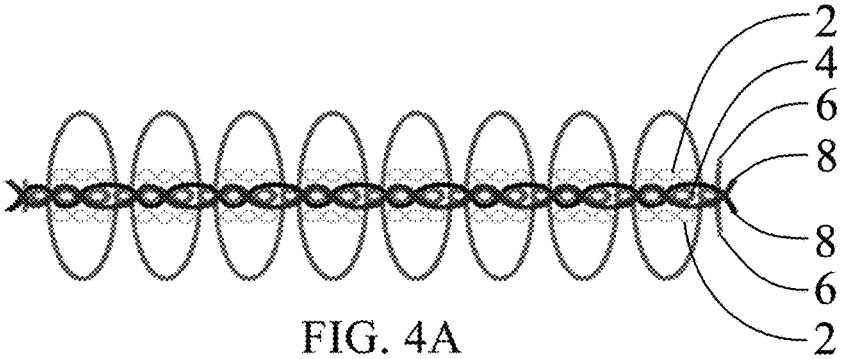
FIGS. 4A-4C are schematic diagrams of a double-faced pile loop fabrics with three weft floats embedded in the loops, where
Figure 4B:
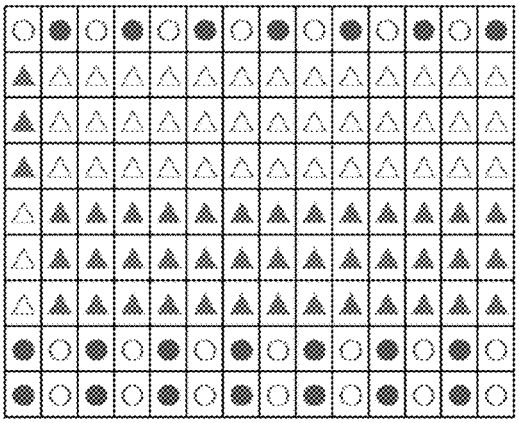
Figure 4C:
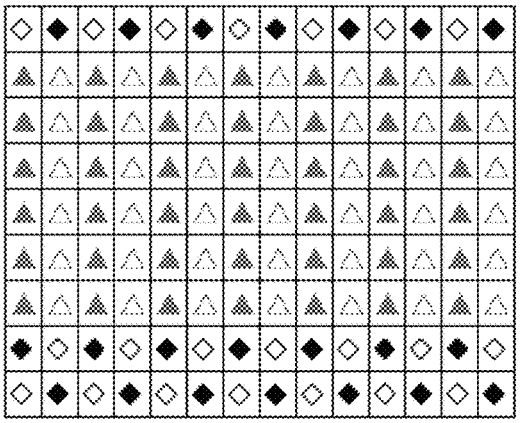

FIGS. 2A-2C and 4A-4C illustrate a durable fluffy and soft double-faced pile loop fabric having embedded weft floats with the double-faced pile loop towel structure of three-weft pile embedded with 1 and 3 floating weft yarns of polyester filament respectively.

The production method of embedded weft floats loop fabrics with weaving process is as follows: winding, warping, weaving, dyeing and sewing.

1. Yarn selection: prepare the yarns with prior arts: pile warp yarns are 12s cotton untwisted yarns, the ground warp yarns are 21s/2 polyester dyed yarns, fixed loop weft yarns are 16s cotton yarns, and embedded floating weft yarns are polyester 600D/576F draw texturing yarn filament yarns.

2. Winding: the existing well-known technology is used for winding on winder such as the SAVIO winder which is made in Japan.

3. Warping: the existing well-known technology is used to prepare a pile warp beam and a ground warp beam on a warping machine such as a BENNINGER batch warping machine.

4. Sizing: sizing the ground warp beam on a sizing machine such as the KAL-MAYER sizing machine using the existing well-known technology.

5. Weaving: for the double-faced pile loop fabric, a loop structure of fixed loop structure adopts 2/1 modified warp-rib weaves, a ground structure adopts 2/1 warp-rib weaves, two short beating up and one long beating up for each loop; interlacing structures of embedded float weft yarns and ground warps are 13/1 weft-rib weaves. Towel rapier loom such as G6300 rapier loom is used.

6. Dyeing and finishing: the specific steps are as follows:

Removal of water soluble silk: the fabric is added when water reaches 90° C. and treated at 100° C. for 50 minutes.

Deoiling of polyester: a dosage of polyester deoiling agent such as TF-129T of TRANSFAR® is 3 g/l, treating for 30 Min at 100° C.

Refining and bleaching: the fabric is contacted with a solution containing chelating agent: 0.5 g/l, hydrogen peroxide (mass concentration of 27%): 5 g/l, ionic membrane caustic soda (mass concentration of 32%): 8 g/l, stabilizer of hydrogen peroxide: 0.3 g/l, highly concentrated refining agent in dosage of 1.5 g/l at 98° C. for 60 minutes.

Dyeing: heat up from 30° C. to 60° C., at a speed of 1° C./min, and maintain the temperature of 60° C. for 30 minutes, reactive dyes are adopted.

Thermal washing, soaping: carry out thermal washing for 10 minutes at 85° C., and carry out soaping for 15 minutes at 95° C.

Polishing: a neutral polishing enzyme of NOVOZYMES 8000L is used for polishing, a dosage of the polishing enzyme is 0.05% on weight of fabric, take polishing treatment for 40 minutes at 55° C.

Soft finishing: a softening agent such as HUNTSMAN softening agent SFC, with dosage of 3 g/l, carry out soft finishing for 30 minutes at 40° C.

Dehydrating, drying, a loose dryer is used for drying, the loose dryer is made in Jiangyin, Jiangsu, model: WMH240. sewing, and a towel fabric is obtained.

The weft yarns of the fixed loops are natural fiber yarn, and the embedded floating weft yarns are chemical fiber untwist yarns or chemical fiber draw texturing yarn filament.

Embodiment 3

A durable fluffy and soft single-faced four-weft pile loop fabric having embedded weft floats, the pile structure in the preparation steps is changed from three-weft pile to four-weft pile on the basis of embodiment 2, and the other parts of the embodiment are similar to that of embodiment 2.

Embodiment 4

A durable fluffy and soft double-faced four-weft pile loop fabric having embedded weft floats, the pile structure in the preparation steps is changed from three-weft pile to four-weft pile on the basis of embodiment 2, and the other parts of the embodiment are similar to that of embodiment 2.

In conclusion, the towels in above mentioned embodiments are tested and show excellent properties of durable softness, high water absorption and quick drying properties. And compared with the existing ordinary towel on the market, the towels has better performance and is very suitable for promotion and use.

The invention claimed is:

1. A method for producing durable fluffy and soft loop fabric having embedded weft floats, comprising:

selecting fixed loop weft yarns and embedded floating weft yarns, which are yarns with a twist factor less than 260, wherein a ratio of the fixed loop weft yarns and the embedded floating weft yarns is 3:n to 7:n, where n is a number equal to or greater than 1;

winding the fixed loop weft yarns and the embedded floating weft yarns;

warping the fixed loop weft yarns and the embedded floating weft yarns;

sizing the fixed loop weft yarns and the embedded floating weft yarns;

weaving the fixed loop weft yarns and the embedded floating weft yarns, wherein during the weaving:

a loop structure adopts 2/1 modified warp-rib weaves, a ground structure adopts 2/1 warp-rib weaves, two short beating up and one long beating up for each loop;

a number of warp yarns crossed by the embedded floating weft yarns of a pile loop fabric is not less than 6, a number of the embedded floating weft yarns is not less than 1; and interlacing structures of the embedded float weft yarns and ground warps are 13/1 or 16/1 or 24/1 or 32/1 weft-rib weaves;

dyeing and finishing the fixed loop weft yarns and the embedded floating weft yarns.

2. The method according to claim 1, wherein the embedded floating weft yarns are 5-16s untwisted yarns in polyester or 200D-800D draw texturing yarn filament yarns in polyester.

3. The method according to claim 1, wherein the number of warp yarns crossed by the embedded floating weft yarns of the pile loop fabric is 10 to 32, the number of the embedded floating weft yarns is 2 to 4.

4. The method according to claim 1, wherein the dyeing and finishing process includes:

removing water soluble silk, wherein fabric is added when water reaches 90° C. and treated at 100° C. for 50 minutes;

deoiling polyester, wherein a dosage of polyester deoiling agent is 3 g/l, treating for 30 min at 100° C.;

refining and bleaching, wherein fabric is contacted with a solution containing chelating agent: 0.5 g/l, hydrogen peroxide: 5 g/l, ionic membrane caustic soda: 8 g/l, stabilizer of hydrogen peroxide: 0.3 g/l, highly concentrated refining agent in dosage of 1.5 g/l at 98° C. for 60 minutes;

dyeing and heating, wherein heating up from 30° C. to 60° C., at a speed of 1° C./min, and maintaining the temperature of 60° C. for 30 minutes, reactive dyes are adopted;

thermal washing, and soaping, wherein out thermal washing for 10 minutes at 85° C., and carrying out soaping for 15 minutes at 95° C.;

polishing, wherein a polishing enzyme is used for polishing, a dosage of the polishing enzyme is 0.05% on weight of fabric, take polishing treatment for 40 minutes at 55° C.;

soft finishing, wherein softening agent with antistatic function is selected in the process of soft finishing.

5. The method according to claim 4, wherein the polishing enzyme is a neutral polishing enzyme.

6. The method according to claim 4, wherein the drying is carried out by a loose dryer.

* * * * *